US007332064B2

(12) United States Patent
Webb

(10) Patent No.: US 7,332,064 B2
(45) Date of Patent: Feb. 19, 2008

(54) HANGAR BAR

(75) Inventor: Wayne Keith Webb, Queensland (AU)

(73) Assignee: Mount Isa Mines Limited, Brisbane Queensland (AU)

( * ) Notice: Subject to any disclaimer, the term of this patent is extended or adjusted under 35 U.S.C. 154(b) by 329 days.

(21) Appl. No.: 10/501,735

(22) PCT Filed: Jan. 28, 2003

(86) PCT No.: PCT/AU03/00086

§ 371 (c)(1),
(2), (4) Date: Jul. 16, 2004

(87) PCT Pub. No.: WO03/062497

PCT Pub. Date: Jul. 31, 2003

(65) Prior Publication Data

US 2005/0126906 A1 Jun. 16, 2005

(30) Foreign Application Priority Data

Jan. 25, 2002 (AU) ..... PS0159

(51) Int. Cl.
*C25D 17/12* (2006.01)
*C25B 9/02* (2006.01)

(52) U.S. Cl. ..... 204/281; 204/286.1; 204/288.2; 29/462; 29/729; 29/746

(58) Field of Classification Search ..... 204/279, 204/281, 286.1, 288.2, 289
See application file for complete search history.

(56) References Cited

U.S. PATENT DOCUMENTS 4,186,074 A * 1/1980 Perry ..... 204/288.2
4,373,654 A 2/1983 Prengaman et al.
4,882,027 A * 11/1989 Borst et al. ..... 204/288.2
5,492,609 A 2/1996 Assenmacher
6,131,798 A 10/2000 Prengaman
6,569,300 B1 * 5/2003 Assenmacher ..... 204/286.1
2003/0010630 A1 1/2003 Polvi et al.

FOREIGN PATENT DOCUMENTS

| | | |
|---|---|---|
| DE | 4241485 | 3/1993 |
| JP | 5179478 | 7/1993 |
| WO | 0039366 | 7/2000 |
| WO | 0163013 | 8/2001 |

* cited by examiner

*Primary Examiner*—Bruce F. Bell
(74) *Attorney, Agent, or Firm*—Stevens, Davis, Miller & Mosher, LLP

(57) ABSTRACT

A hangar bar for a cathode plate and a method of producing a cathode for electrolytic recovery of metal. The hanger bar comprises a support element which is preferably stainless steel and hollow. An electrically conductive metal cladding is affixed the stainless steel bar by any appropriate mechanism, eg interference fit, welding, chemical or mechanical fastening or coextrusion or roll forming. Affixing the cladding to the stainless steel support element has significant advantages over conventional electroplating techniques including that a more precise engineering specification can be applied to the cladding thickness. This is important to maintain vertical alignment of the cathode plate in the electrolytic cell.

25 Claims, 2 Drawing Sheets

HANGAR BAR

This application is a §371 National Stage Application of International Application No. PCT/AU03/00086, filed on 28 Jan. 2003, claiming the priority of Australian Patent Application No. PS0159 filed on 25 Jan. 2002.

1. Technical Field

The present invention relates to cathodes used in electrolytic recovery of metals.

2. Background Art

Any discussion of the prior art throughout the specification should in no way be considered as an admission that such prior art is widely known or forms part of common general knowledge in the field.

There are various processes and apparatus for electro-refining or electro-winning of metal. One particularly successful process for electro-depositing of copper, for example, is the so called ISA PROCESS. In this process, stainless steel cathode mother plates are immersed in an electrolyte bath with copper anodes. The copper from the anodes dissolve into the electrolyte and are subsequently deposited in a refined form onto the blade of the mother plate. The electrolytically deposited copper is then stripped from the blade by first flexing the cathode plate to cause at least part of the copper deposit to separate from the blade, and then wedge stripping or gas blasting the remainder of the copper from the blade.

The cathode mother plate generally consists of a stainless steel blade, and a hanger bar connected to the top edge of the blade to hold and support the cathode in the electrolytic bath.

There are a wide variety of hanger bar constructions. Early cathode plates used solid copper hanger bars which provided not only excellent electrical conductivity but adequate strength to support both the cathode plate and the metal deposited thereon. It was discovered, however, that under repeated use both in the electrolytic bath and in the stripping machinery the relatively ductile copper bar tended to bend or be damaged.

In addition, connection of the stainless steel blade to the copper hanger bar was sometimes difficult. To overcome this difficulty, complex construction and welding techniques were required. In one instance, as discussed in U.S. Pat. No. 5,492,609, additional parallel grooves were machined in the hanger bar on either side of the central groove which accepts the cathode blade. The cathode blade and the hanger bar were then welded together along this inset groove, the ridges formed between the parallel grooves and the sheet then being used as welding material. This process sometimes required the copper hanger bar and steel cathode blade to be welded in a thermally conductive liquid to maintain the bar at a constant uniform temperature.

The cost, complexity and durability of the copper hanger bar led the industry to use iron or steel hanger bars for greater structural strength. In most cases, while structural integrity was good, the iron or stainless steel was a poor conductor of electricity. Accordingly, in another technique a coating of electrically conductive metal was electrolytically deposited on the hanger bar. Such iron or steel hanger bars with electrolytically deposited conductive metal, came in various shapes such as simple solid beams, I-beams or hollow sections.

Once again, however, it was found that these new configurations had their own difficulties. Firstly, such a coating technique only permits tolerances within the technical limitation of the electroplating process. The thickness and adhesion of the metal coating is additionally limited by the electroplating process.

It is an object of the present invention to overcome or ameliorate at least one of the disadvantages of the prior art, or to provide a useful alternative.

DISCLOSURE OF THE INVENTION

In a broad aspect, the present invention provides a hanger bar for a cathode plate used in electrolytic recovery of metal comprising a corrosion resistant support element adapted for connection to a blade of the the cathode plate, at least a portion of said support having an electrically conductive metal cladding affixed thereto.

The support element should be resistant to corrosion in the environment of use, ie in the electrolytic bath. Preferably, the corrosion resistant support element is made from stainless steel and is preferably hollow.

The electrically conductive metal cladding may be affixed to and cover a portion or the entire exterior of the stainless steel support. This is accomplished by any suitable technique eg an interference fit, welding, chemical or mechanical fastening, roll forming, etc.

The use of stainless steel as the support element imparts strength, long term durability and corrosion resistance for the hanger bar. These features are clearly important in obtaining an extended operational life for the hanger bar. However, as is well known in the art, stainless steel is a relatively poor electrical conductor. The introduction of an electrically conductive metal cladding will permit the ready transfer of electrical current along the hanger bar into the blade of the cathode plate.

However, unlike the prior art this electrical conductivity is achieved by affixing a cladding of electrically conductive material. Mechanically fitting the cladding permits a more precise engineering specification to be applied to the cladding thickness and consequently aids in the maintaining vertical alignment of the cathodes in the electrolytic cells. As discussed above, tolerances now required for operation of electrolytic cells at high current density cannot be easily achieved by other conventional mechanisms such as electroplating of the stainless steel hanger bar.

In addition, the necessary strength for the hanger bar cannot be obtained from the use of copper alloy within the hanger bar construction.

In a preferred embodiment, the electrically conductive cladding surrounds the exposed portions of the support element, and extends part way down from the support element along the blade of the cathode. This embodiment reduces the electrical resistance to current passing through the bar onto the blade and in addition reduces the possibility of bi-metallic corrosion of the joint between the electrically conductive metal and the cathode blade which is normally made from stainless steel.

In addition to the aforementioned advantages arising from use of the hanger bar, the production of the hanger bar itself is much simpler that conventional mechanisms. For instance, it is not necessary to use a portion of the hanger bar as weld material. Nor is it necessary to electroplate the hanger bar. As will be known to persons skilled in the art, in one conventional technique, for production of the cathode plate, after the hanger bar is welded to the cathode blade, the entire assembly is inverted and dipped into an electrolytic bath a sufficient depth to electroplate the hanger bar with a conductive metal. The cost and handling difficulties associated with this mechanism are clear. Affixing a cladding of electrically conductive metal to the support element is much simpler, more cost effective and more accurate than current techniques.

In a second embodiment, the present invention provides a method of producing a cathode plate for electrolytic recovery of metal comprising providing a cathode blade, connecting a corrosion resistant support element to the cathode blade and affixing a cladding of electrically conductive metal to the support element.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

BRIEF DESCRIPTION OF THE DRAWINGS

The present invention will now be described by way of example only with reference to the accompanying drawings in which.

BEST MODE FOR CARRYING OUT THE INVENTION

Figure 1:
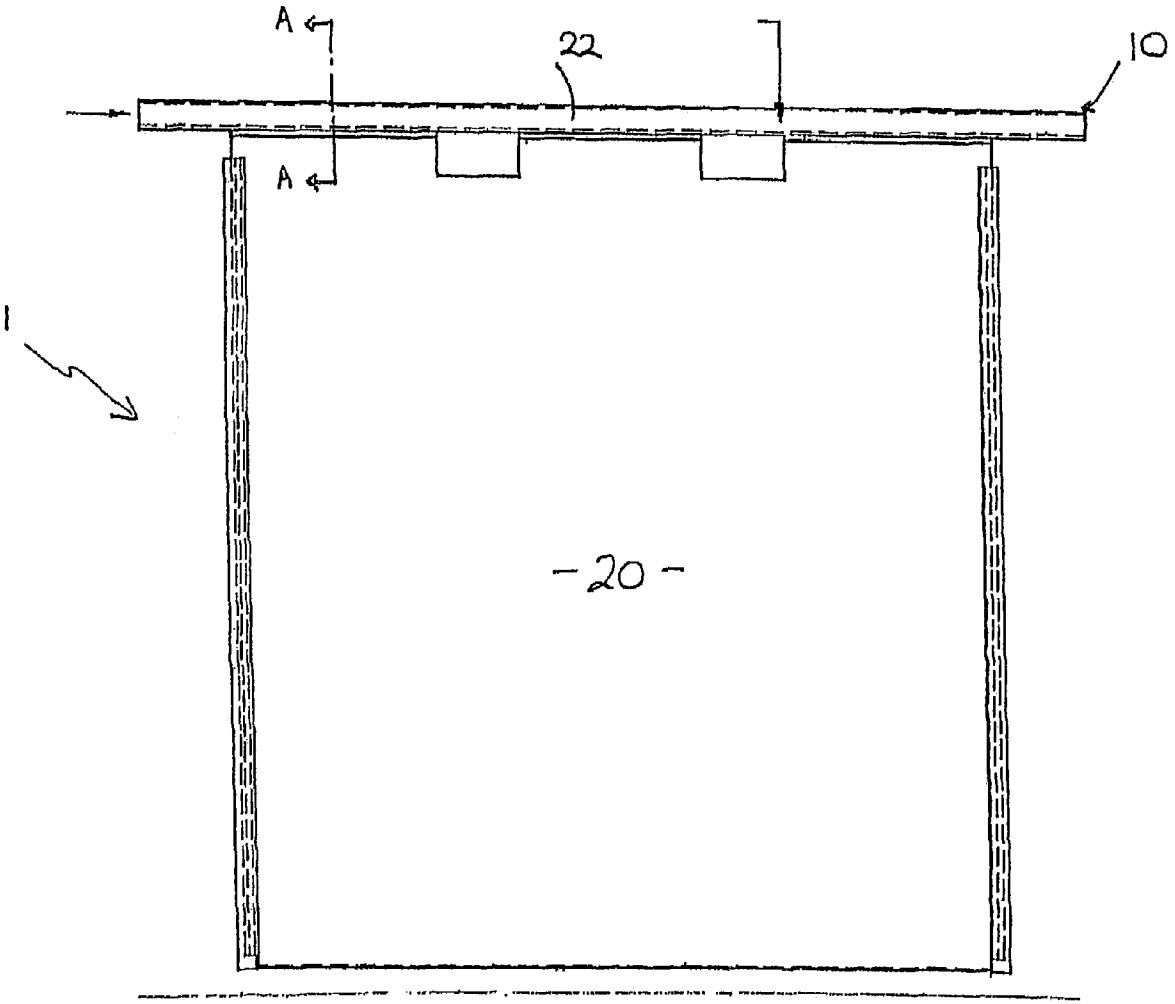
FIG. 1 is a front elevational view of a cathode plate incorporating the hanger bar of the present invention.

As shown in FIG. 1, a cathode plate 1 comprises a hanger bar 10 and a cathode blade 20. Windows 15 are cut from the cathode blade 20 to assist in lifting and transportation of the cathode 1.

As mentioned above, when electro-refining copper according to the ISA PROCESS, the cathode blade 20 is a stainless steel blade. However, it will be appreciated that the blade can be manufactured from any suitable material. Titanium and other metals may be used in electro-refining operations.

Figure 2:
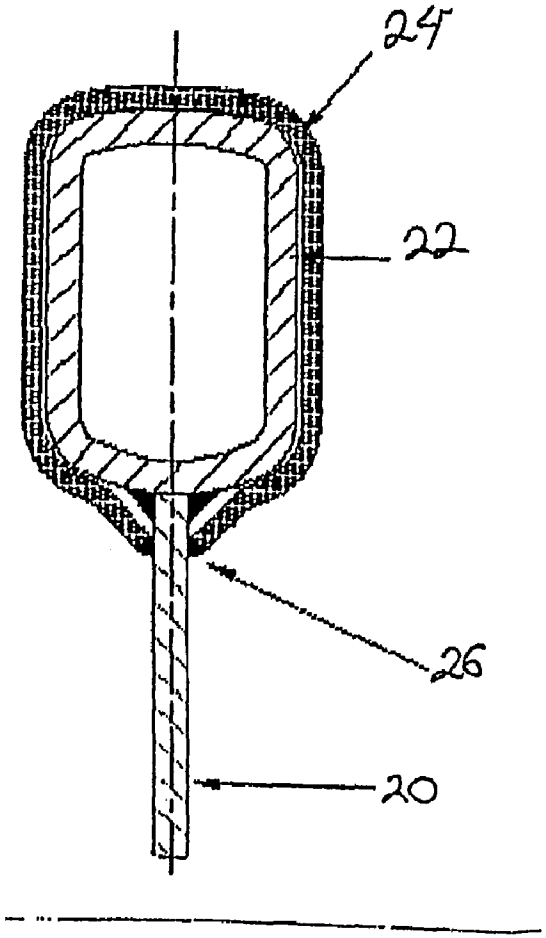
FIG. 2 is a sectional view through section A-A of FIG. 1 showing the hanger bar in use according to a first embodiment of the present invention.

As shown more clearly in FIG. 2, the hanger bar 10 comprises a support element 22 with a cladding 24 of electrically conductive metal affixed thereto.

In this embodiment the support element 10 is stainless steel bar. The stainless steel bar 22 is hollow but is preferably sealed at the ends. It is not essential that the stainless steel bar 22 be hollow.

The cladding of electrically conductive material 24, in this example copper, is affixed around the stainless steel bar 22. This sleeve acts to conduct electricity from the electrical connections in the electrolytic bath through the hanger bar to the cathode blade. Typically, the cladding would be around 2 to 4 mm thick.

Welds 26 run along the terminating edge of copper cladding 24 connecting the copper sleeve to the plate/bar assembly. The Applicant has found that any welding material is suitable provided it can withstand the electrolytic environment in which the cathode plate is used. Aluminium bronze and silicone bronze are particularly suitable weld metals.

It should be noted that the cladding may be affixed to the support element by a variety of techniques including interference fit, chemical or mechanical fastening or roll forming.

Figure 3:
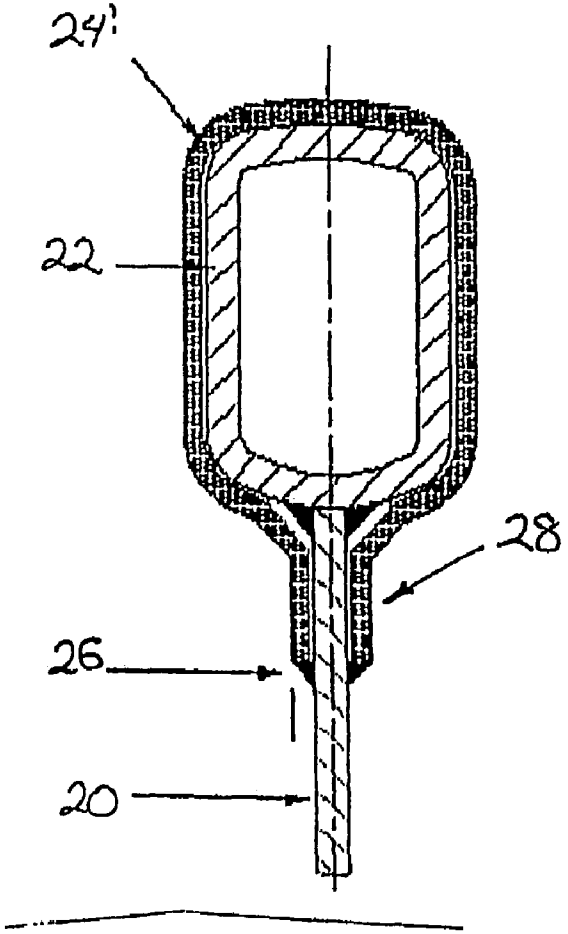
FIG. 3 is a cross sectional view showing the hanger bar and cathode blade according to a second embodiment of the present invention.

As shown in FIG. 3, the sleeve may include an extension 28 onto the cathode plate 10. The intention of this extension is to reduce electrical resistance between the hanger bar and the copper blade, and reduce bi-metallic corrosion between the hanger bar and the plate. Preferably, this extension terminates on or about the level of windows 23 or 30 to 40 mm above the level of electrolyte.

The Applicants have surprisingly found that affixing the electrically conductive metal cladding to a stainless steel support element has significant advantages over conventional electroplating systems.

The separate manufacture and subsequent affixing of the cladding to the support element provides for closer tolerances and a more precise engineering of the cladding thickness. This is important to maintain vertical alignment of the cathode plate in the electrolytic cell when resting on the electrical connectors either side of the electrolytic bar.

No current process allows such fine tolerances to be applied to the hanger bar construction and as far as the applicant can ascertain this affixing of the electrically conductive sleeve over the stainless steel hanger bar has not been proposed to date.

In addition, having a stainless steel core, the bar will retain long term mechanical strength with ease of manufacture. It will also be appreciated that this construction has advantages in terms of maintenance. For instance, if the sleeve/cladding of conducting material is damaged, it is a simple matter to remove the cladding and replace. This can also be applied to current hanger bars with electrolytic coatings of conductive material. If these coatings are damaged or it is found that the cathode plate is not performing adequately in the cell due to poor alignment, the present invention allows precise tolerances to be applied to the hanger bar not only to repair the hanger bar but provide a more precise engineering of the cladding thickness and hence alignment of the cathode plate in the bar.

The hanger bar and method of production may be embodied in other forms without departing from the spirit or scope of the present invention.

The invention claimed is:

1. A cathode plate for electrolytic recovery of metal, said plate including a cathode blade having a first and second face for metal deposition thereon, and a hanger bar, said hanger bar comprising a corrosion resistant support element connected to the blade of the cathode plate and an electrically conductive metal cladding affixed thereto, the electrically conductive metal cladding extending over at least a portion of the support element to the cathode blade and extending downwardly from the support element part way down both first and second faces of the cathode blade.

2. A cathode plate as claimed in claim 1, wherein the support element is constructed from stainless steel.

3. A cathode plate as claimed in claim 1, wherein the electrically conductive metal cladding is affixed such that it covers the entire exterior of the support element.

4. A cathode plate as claimed in claim 1, wherein the electrically conductive metal cladding is interference fitted to the support element.

5. A cathode plate as claimed in claim 1, wherein the electrically conductive metal cladding is welded to the support element.

6. A cathode plate as claimed in claim 5, wherein the electrically conductive metal cladding is welded to the support element and/or cathode blade by aluminum bronze weld.

7. A cathode plate as claimed in claim 5, wherein the electrically conductive metal cladding is welded to the support element and/or cathode blade by silicone bronze weld.

8. A hanger bar claimed in claim 1, wherein the electrically conductive metal cladding is mechanically and/or chemically fastened to the support element.

9. A cathode plate as claimed in claim 1, wherein the support element is co-extruded with the electrically conductive metal cladding.

10. A cathode plate as claimed in claim 1, wherein the electrically conductive metal cladding is roll-formed onto the support element.

11. A cathode plate as claimed in claim 10, wherein the cladding extends from the support element to a position 30 to 40 mm above the metal deposition area on the cathode blade.

12. A hanger bar as claimed in claim 1, wherein the blade comprises stainless steel.

13. A hanger bar as claimed in claim 1, wherein the electrically conductive metal is copper.

14. A cathode plate for electrolytic recovery of metal, said plate including a cathode blade and a hanger bar, said hanger bar comprising a corrosion resistant support element connected to the blade of the cathode plate and an electrically conductive metal cladding affixed thereto, the electrically conductive metal cladding extending over at least a portion of the support element to the cathode blade part way down the cathode blade, wherein said support element is hollow.

15. A method of producing a cathode plate for electrolytic recovery of metal comprising a cathode blade having first and second faces for metal deposition thereon, said method comprising connecting a corrosion resistant support element to the cathode blade, said element being adapted to support the cathode plate in an electrolytic bath, and affixing a cladding of electrically conductive metal to the support element wherein the electrically conductive metal cladding extends over at least a portion of the support element downward to the cathode blade and part way down both first and second faces of the cathode blade.

16. A method as claimed in claim 15, wherein the cladding is affixed to the support element after connection of the support element and cathode blade.

17. A method as claimed in claim 15, wherein the cladding is affixed to the support element before connection of the support element to the cathode blade.

18. A method as claimed in claim 15, wherein the electrically conductive metal cladding is affixed by an interference fit.

19. A method as claimed in claim 15, wherein the electrically conductive metal cladding is affixed by welding.

20. A method as claimed in claim 19, wherein the electrically conductive metal cladding is welded to the support element and/or cathode blade by aluminum bronze weld.

21. A method as claimed in claim 19, wherein the electrically conductive metal cladding is welded to he support element and/or cathode plate by silicone bronze weld.

22. A method as claimed in claim 15, wherein the electrically conductive metal cladding is affixed by chemical or mechanical fastening.

23. A method as claimed in claim 15, wherein the support and electrically conductive metal cladding are affixed by roll forming.

24. A method as claimed in claim 15, wherein the cathode blade and/or support element are constructed from stainless steel.

25. A method as claimed in claim 15, wherein the electrically conductive metal is copper.

* * * * *